US006513299B1

(12) United States Patent
Damiano

(10) Patent No.: US 6,513,299 B1
(45) Date of Patent: Feb. 4, 2003

(54) ANTENNA SUPPORT

(75) Inventor: Armand A. Damiano, Omaha, NE (US)

(73) Assignee: Valmont Industries, Inc., Valley, NE (US)

( * ) Notice: Subject to any disclaimer, the term of this patent is extended or adjusted under 35 U.S.C. 154(b) by 34 days.

(21) Appl. No.: 09/664,164

(22) Filed: Sep. 18, 2000

(51) Int. Cl.[7] ..... E04H 12/00

(52) U.S. Cl. ..... 52/651.02; 52/40; 52/651.04; 52/736.4; 343/874

(58) Field of Search ..... 52/40, 651.02, 52/651.04, 651.07, 651.11, 653.2, 223.4, 292, 736.2, 736.4; 248/121; 343/874

(56) References Cited

U.S. PATENT DOCUMENTS 3,780,480 A * 12/1973 Cvijanovic ..... 52/227
5,649,402 A 7/1997 Moore
5,787,673 A * 8/1998 Noble ..... 52/726.1
6,028,566 A * 2/2000 Pennell et al. ..... 343/878

* cited by examiner

*Primary Examiner*—Carl D. Friedman
*Assistant Examiner*—Jennifer I. Thissell
(74) *Attorney, Agent, or Firm*—Thomte, Mazour & Niebergall; Dennis L. Thomte

(57) ABSTRACT

An antenna support for a power transmission tower having a vertically disposed mast extending upwardly through the tower with the antenna support being mounted on the upper end of the mast. The weight of antenna support is transferred to the legs of the tower rather than to the mast through the use of support bracing extending between the elongated pipe and the tower. An antenna platform is mounted on the upper end of the mast with the weight thereof being supported by the elongated pipe. The platform is comprised of three triangular-shaped platform sections having mounting rings at the inner ends thereof which are slipped over the upper end of the mast with the lowermost mounting ring resting upon the upper end of the elongated pipe. The antenna support may be mounted on a cellular transmitting/receiving tower or on a guy-wired mast.

12 Claims, 6 Drawing Sheets

ANTENNA SUPPORT

BACKGROUND OF THE INVENTION

1. Field of the Invention

This invention relates to a an antenna support and more particularly to an antenna support which may be mounted on an electrical power transmission tower.

2. Description of the Related Art

An antenna support for a power transmission tower is disclosed in U.S. Pat. No. 5,649,402 with the antenna support including a support column positioned within the tower and having its base anchored in the ground. An antenna assembly is mounted on the upper end of the column. The column is secured to the tower for lateral support only by the tower so that substantially all of the weight of the antenna assembly is supported by the column and transferred to the base. The stated reason for having the base of the support column anchored in the ground with the tower only providing lateral support is that the weight of the antenna disclosed in U.S. Pat. No. 5,649,402, if supported by the tower, would cause the tower to perhaps collapse.

The applicant herein has devised an antenna support which is much lighter than conventional antenna supports with its lightweight characteristics enabling the antenna support to be supported by the tower. Further, the antenna support of this invention is extremely easy to erect. Additionally, the antenna support of the invention may be mounted on towers other than electrical power transmission towers and may also be mounted on vertically disposed masts.

SUMMARY OF THE INVENTION

An antenna support is disclosed which may be used with an electrical power transmission tower, a cellular telephone transmission/receiving tower, or a vertically disposed mast. When the antenna support of this invention is used on an electrical power transmission tower, a vertically disposed mast is positioned between the legs of the tower with the mast being connected to the legs or lattice braces of the tower to provide lateral stability to the mast. An elongated pipe is positioned below the upper end of the mast and embraces the same. The elongated pipe is operatively secured to the legs of the tower by means of support bracing secured to and extending therebetween so that the tower supports the weight of the elongated pipe. The antenna support includes three triangular-shaped platform sections which have mounting rings at their inner ends which rest upon and are supported by the upper end of the elongated pipe. The positioning of the mounting rings on their respective platform sections is such that the mounting rings are stacked one upon the other. The platform sections are comprised of a lightweight composite material such as fiberglass reinforced plastic (FRP). Means is provided for preventing the rotation of the platform sections with respect to the elongated pipe. Antennas are secured to the outer ends of the platform sections.

If the antenna support is being used on a conventional cellular telephone transmission/receiving tower, the platform sections are secured to the tower legs by support bracing so that the weight of the antenna support is borne by the tower rather than the mast. The antenna support is mounted on the mast as in the electrical power transmission tower embodiment.

The antenna support may also be mounted on a guy-wired mast.

A principal object of the invention is to provide a unique antenna support for use on an electrical power transmission tower, a conventional cellular telephone transmission/receiving tower, or a guy-wired mast.

A further object of the invention is to provide an antenna support including lightweight platform sections.

Still another object of the invention is to provide an antenna support for an electrical power transmission tower wherein the weight of the antenna support is borne by the tower.

Yet another object of the invention is to provide an antenna support which is easy to erect.

These and other objects will be apparent to those skilled in the art.

DESCRIPTION OF THE PREFERRED EMBODIMENT

Figure 1:
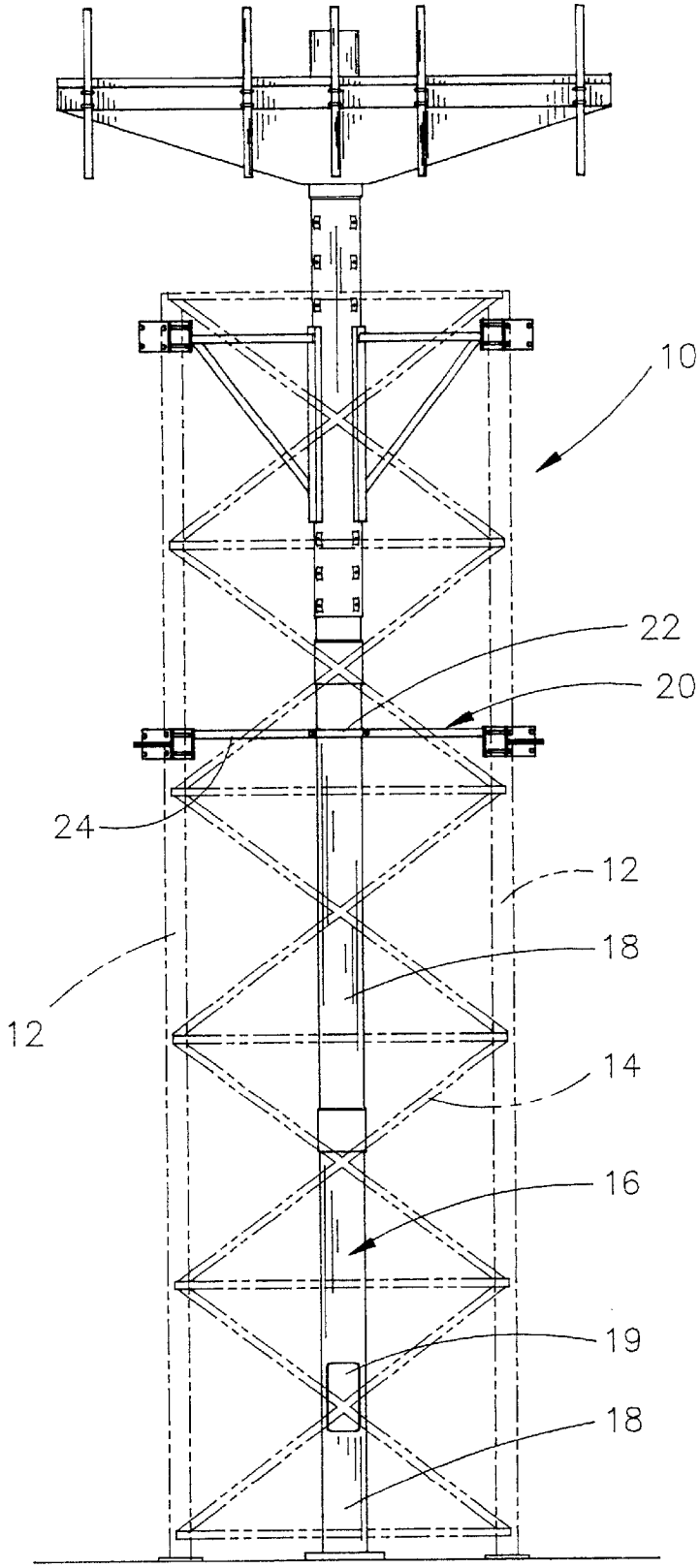
FIG. 1 is a side view of the antenna support of this invention positioned on an electrical power transmission tower.
Figure 2:
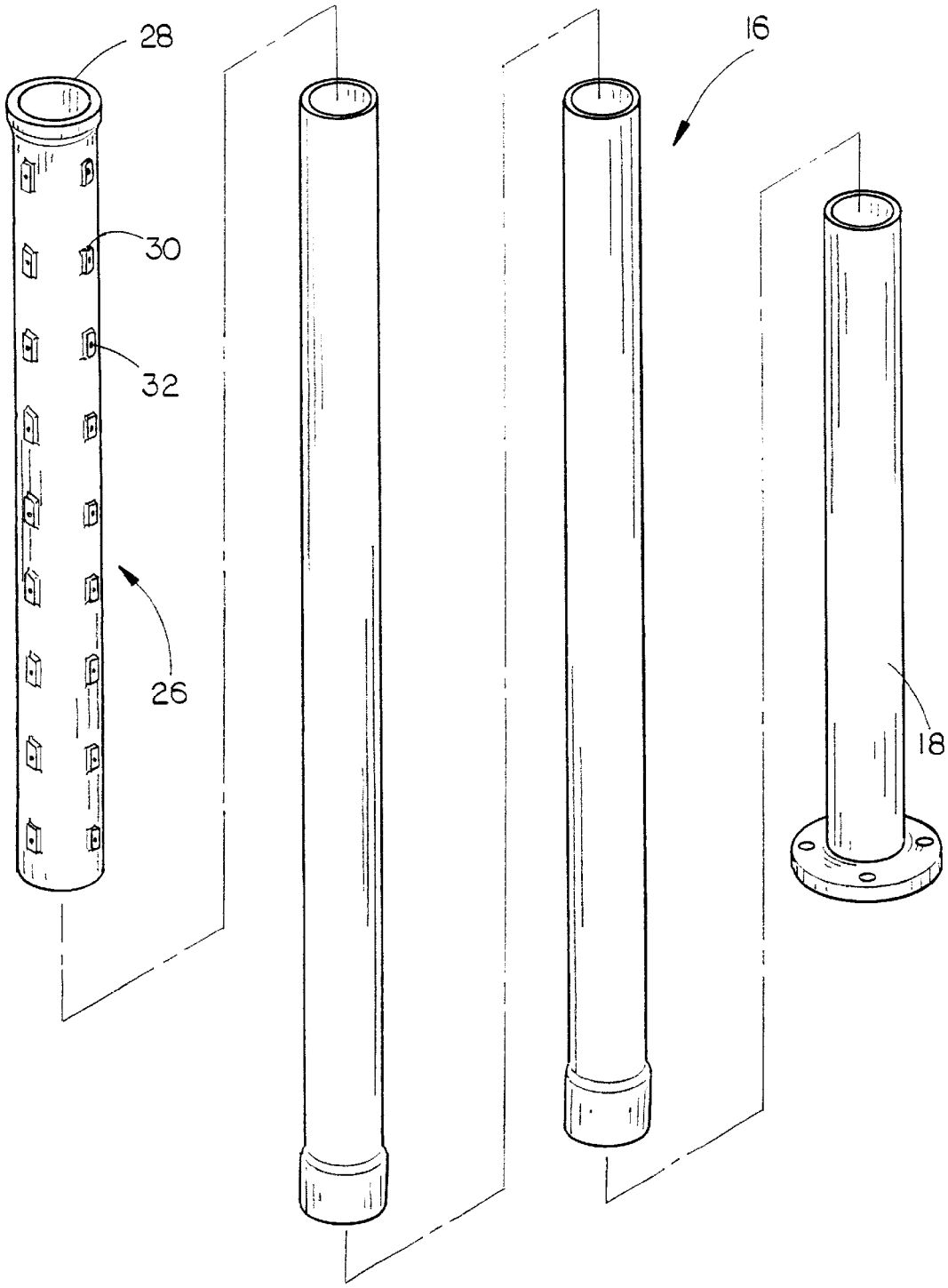
FIG. 2 is an exploded perspective view of the mast and the elongated pipe which embraces the same.
Figure 3:
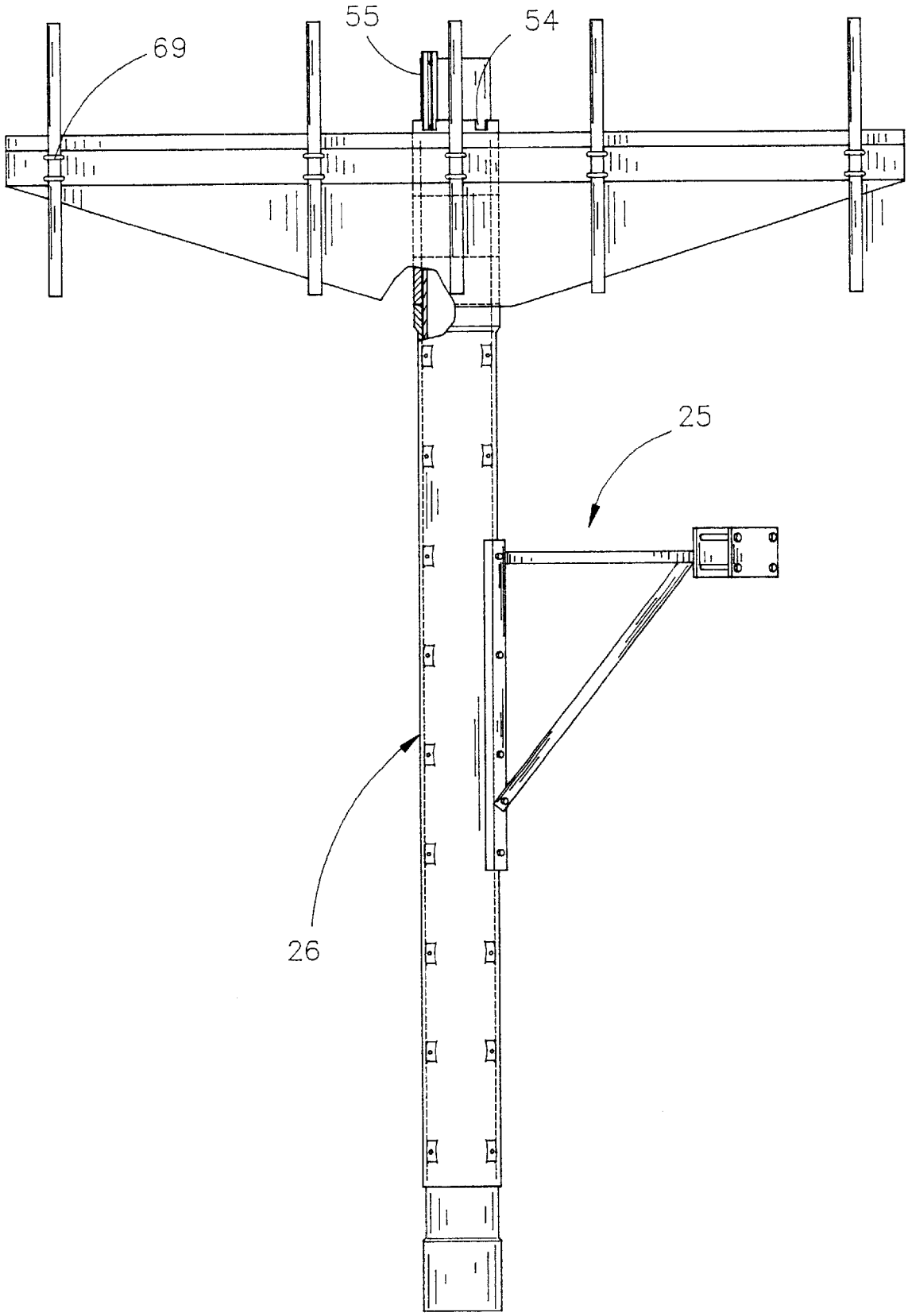
FIG. 3 is a partial side elevational view illustrating the antenna support mounted on the mast.
Figure 4:
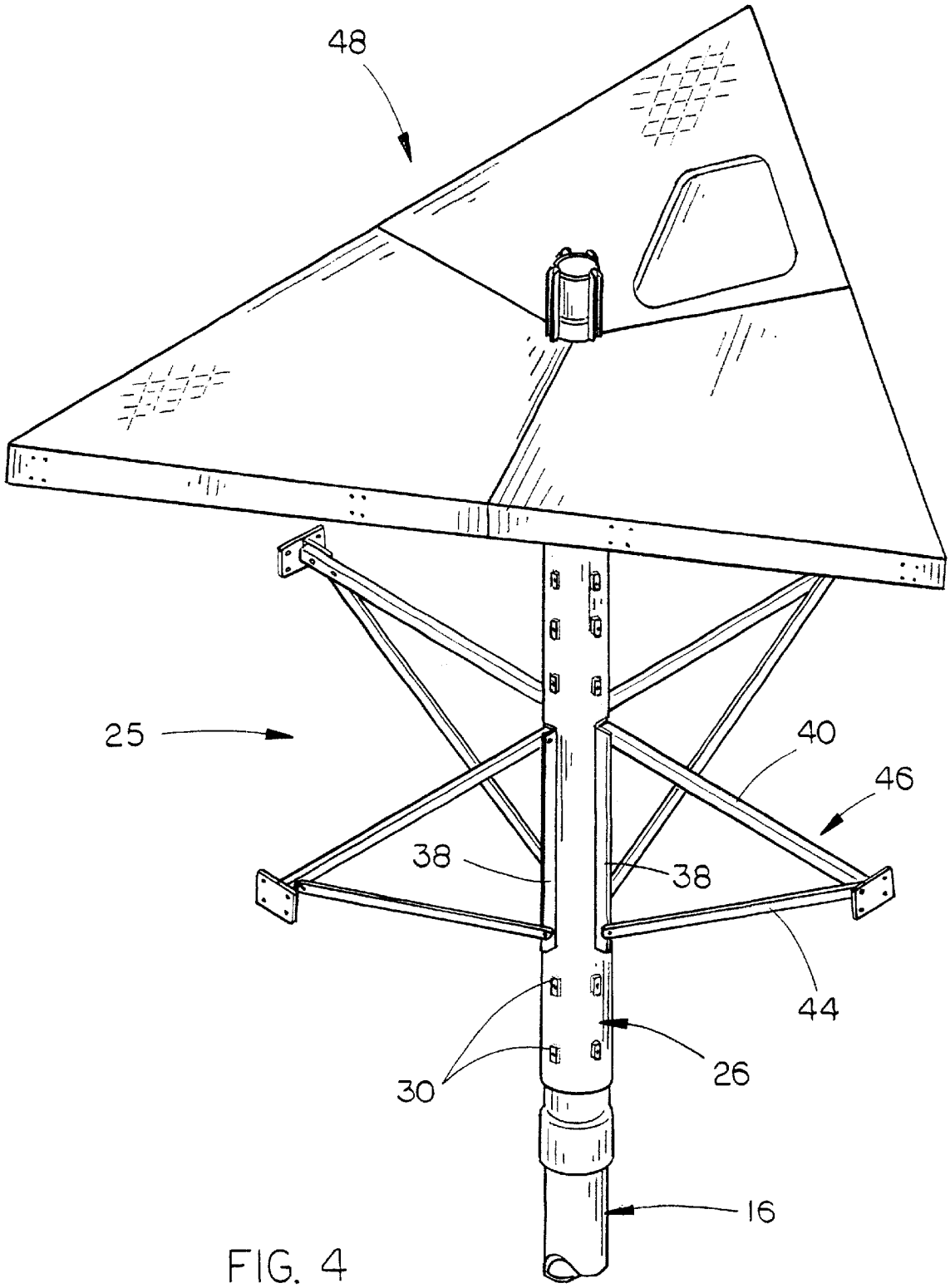
FIG. 4 is a perspective view illustrating the antenna support mounted on the mast.
Figure 5:
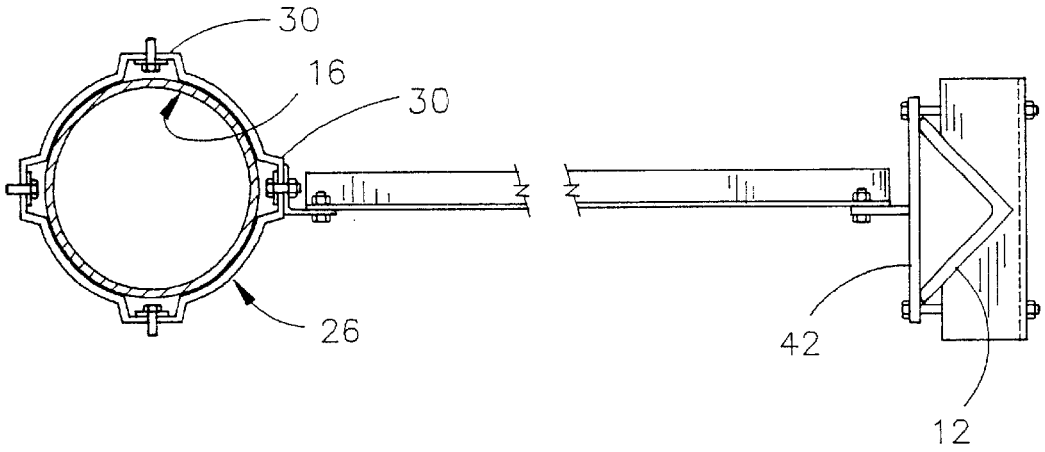
FIG. 5 is a partial sectional view illustrating the manner in which the antenna support is mounted on the mast.
Figure 6:
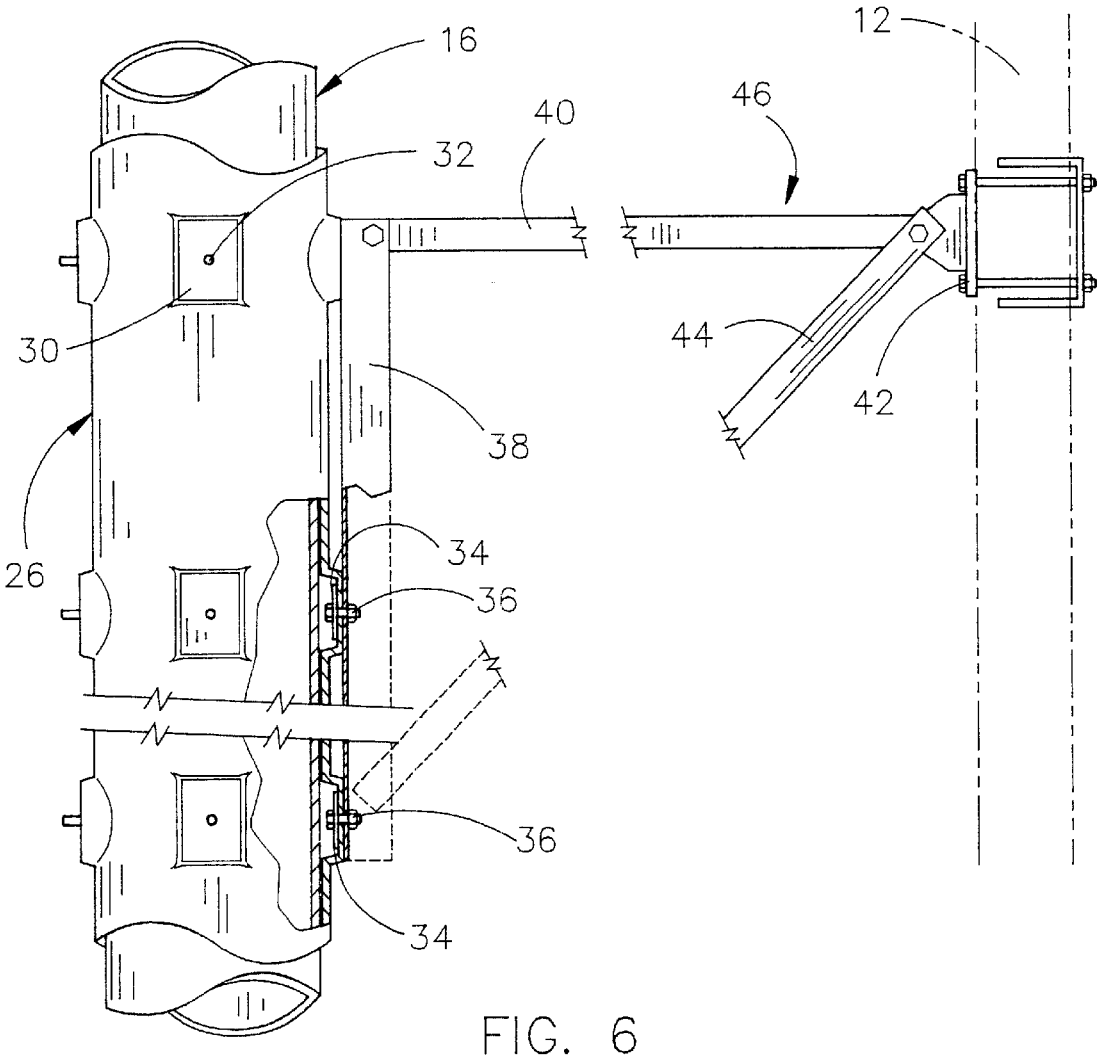
FIG. 6 is a partial side view illustrating the means by which the antenna support is mounted on the mast.
Figure 7:
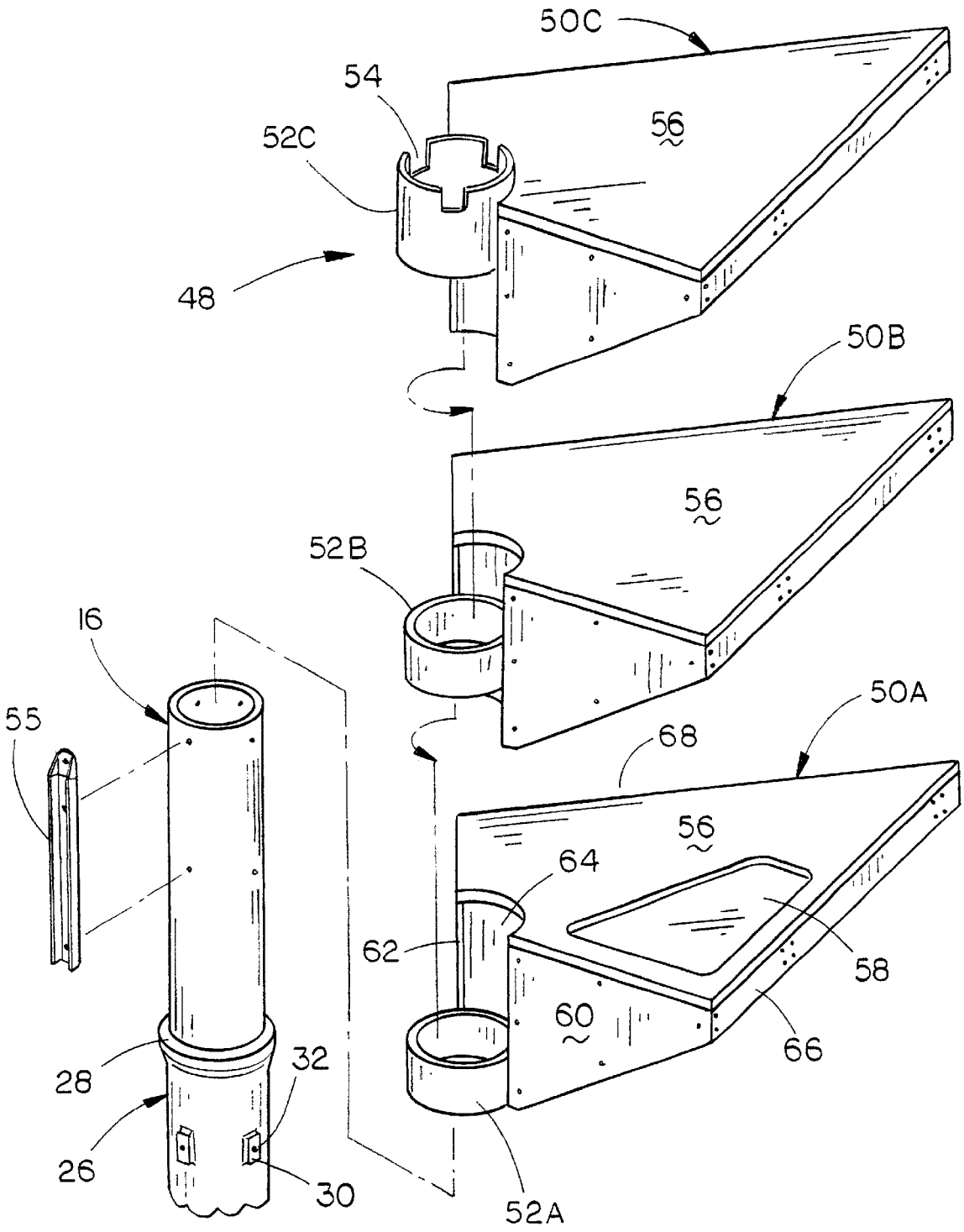
FIG. 7 is an exploded perspective view illustrating the relationship of the antenna support to the mast.

The numeral 10 refers to a conventional electrical power transmission tower including a plurality of upstanding legs 12 which are anchored in the ground and which are interconnected by lattice braces 14. An upstanding hollow mast 16 is positioned between the legs 12 of the tower 10 and extends upwardly from the ground to a location above the upper end of the tower 10. Mast 16 is comprised of a plurality of mast sections 18 which are joined together, as seen in the drawings. It is preferred that the lowermost mast section be comprised of steel and which has a wave guide entry port 19 formed therein to enable a wave guide to be extended upwardly through the mast. It is preferred that the mast sections above the lowermost steel mast section be comprised of a suitable composite material such as fiber reinforced plastic (FRP).

The numeral 20 refers to support bracing including a clamp 22 which is clamped onto the mast 16 and which has support braces 24 secured thereto which extend outwardly therefrom and which are clamped onto the legs of the tower 10. The support bracing 20 only provides lateral stability to the mast 16. Any number of support bracings may be utilized to achieve the desired lateral stability of the mast.

The antenna support of this invention is generally indicated by the reference numeral 25 and includes an elongated pipe 26 preferably comprised of a composite material such as FRP which embraces the upper end of mast 16, as seen in the drawings, so that the upper end of mast 16 is exposed above the upper end of the elongated pipe 26. Pipe 26 has an outwardly flared portion 28 at its upper end for a purpose to be described hereinafter. Pipe 26 is provided with a plurality of raised pad areas 30 having openings 32 formed therein. The raised pad areas 32 are designed so that steel backing plates 34 may be positioned adjacent the inner surface thereof, as seen in the drawings. A bolt 36 extends through each of the steel backing plates for connection to a brace 38 positioned at the exterior surface of the pipe 26. Normally, there will be four rows of raised pad areas 30 if the tower has four legs. A horizontally disposed brace 40 is secured to the upper end of each of the braces 38 and extends outwardly therefrom for connection to a clamp 42 which is secured to one of the legs. Diagonal brace 44 extends downwardly and inwardly from clamp 42 to the brace 38, as seen in the drawings. The lower end of brace 44 is bolted to brace 38. For purposes of description, the braces 38, 40, and 44 will be described as comprising support bracing 46. The bracings 46 interconnect the pipe 26 and the tower legs 12 so that the weight of the pipe 26, and the platform sections to be described hereinafter, are borne by the legs 12 of the tower and are not imposed on the mast 16.

The numeral 48 refers generally to the antenna platform to which the antennas are secured. Antenna platform 48 is comprised of a plurality of platform sections 50A, 50B and 50C. Each of the platform sections 50A, 50B and 50C are generally triangular-shaped and are preferably comprised of a lightweight composite material such as FRP. Mounting ring 52A is secured to the inner end of platform section 50A while mounting ring 52B is secured to the inner end of platform section 50B. Similarly, mounting ring 52C is secured to the inner end of platform section 50C. As seen in the drawings, the vertical position of the mounting rings 52A, 52B and 52C with respect to the platform sections 50A, 50B and 50C are offset from one another so that the mounting rings 52A, 52B and 52C may be slipped over or embrace the upper end of mast 16 in a stacked position. The lower end of mounting ring 52A engages and rests upon the outwardly flared portion 28 of pipe 26. The lower end of mounting ring 52B rests upon the upper end of mounting ring 52A. The lower end of mounting ring 52C rests upon the upper end of mounting ring 52B. The upper end of mounting ring 52C is provided with one or more notches 54 formed therein to enable an anti-rotational member 55 to be received therein to prevent rotation of the antenna support 48 during use. Each of the platform sections includes a platform walking surface 56 which is preferably given a non-slip texture. It is also preferred that at least one of the platform sections have an opening 58 formed therein to enable a worker to pass upwardly therethrough. Although the preferred embodiment of the platform comprises three platform sections, the platform could be formed from fewer platform sections or a greater number of platform sections.

Each of the platform sections 50A, 50B and 50C include a pair of vertically disposed end plates 60 and 62, center web 64 and side plates 66 and 68. The platform sections 50A, 50B and 50C are secured together, as illustrated in the drawings, with the end plate 60 of one platform section being positioned adjacent the end plate 62 of an adjacent platform section. The antennas are mounted on the side plates 66 and 68 by U-bolts 69 or the like.

Thus, the platform sections 50A, 50B and 50C may be assembled at the ground and then raised to the upper end of the mast 16 so that the mounting rings 52A, 52B and 52C slip downwardly over the upper end of the mast 16. When the antenna support 25 is so positioned, the weight of the platform sections, and the antennas mounted thereon, is imposed upon the flared portion 28 of the pipe 26 with that weight being transmitted to the tower itself, through the support bracings 46, rather than the mast 16.

Although the antenna support 25 is ideally suited for use with an electrical power transmission tower 10, the antenna support 25 may be mounted on a mast extending upwardly between the legs of a conventional cellular telephone transmission/receiving tower. Further, the platform 48 may be mounted on a guy-wired mast by slipping the mounting rings 52A, 52B and 52C over the upper end of the mast and then providing some means for preventing the antenna platform 48 from moving downwardly on the mast, which may be accomplished by a suitable collar secured to the mast below the lower end of the mounting ring 52C, much like the outwardly flared portion 28 of the pipe 26.

The weight of the antenna support is much less than the conventional supports which permits the weight of the same to be imposed or transferred to the tower without fear that the tower will collapse from the weight of the antenna support and the antennas mounted thereon. A further advantage of the invention is in the use of the mounting rings 52A, 52B and 52C so that the antenna support may be easily rotatably moved with respect to the mast to enable the antennas thereon to be properly oriented.

It can therefore be seen that the invention accomplishes at least all of its stated objectives.

I claim:

1. In combination with an electrical power transmission tower having a plurality of upstanding legs anchored in the ground and interconnected by lattice braces, comprising:

a vertically disposed mast having upper and lower ends, positioned between the legs of the tower;

an elongated pipe, having upper and lower ends, embraceably positioned on said mast adjacent the upper end thereof;

support bracing secured to and extending between said elongated pipe and the tower whereby the tower supports the weight of said elongated pipe;

and an antenna platform operatively supported by said elongated pipe so that the weight of the antenna platform is placed on said elongated pipe and is transferred to the tower through said support bracing.

2. The combination of claim 1 wherein said elongated pipe is positioned below the upper end of said mast and wherein said antenna platform includes a mounting ring which embraces said mast.

3. The combination of claim 2 further including means for selectively preventing the rotation of said antenna platform with respect to said elongated pipe.

4. The combination of claim 1 wherein said antenna platform rests upon and is supported by said upper end of said elongated pipe.

5. The combination of claim 1 wherein said antenna platform includes a plurality of platform sections.

6. The combination of claim 5 wherein each of said platform sections is triangular-shaped.

7. The combination of claim 5 wherein each of said platform sections has an inner end and wherein a mounting ring is provided at the inner end of each of said platform sections; said mounting rings embracing said mast above said upper end of said elongated pipe and being supported on said upper end of said elongated pipe.

8. The combination of claim 7 wherein each of said mounting rings is vertically offset with respect to one another to enable said mounting rings to be positioned on said upper end of said elongated member in a stacked relationship.

9. The combination of claim 5 wherein said platform sections are comprised of a composite material.

10. The combination of claim 1 wherein said elongated pipe is comprised of a composite material.

11. In combination:

a vertically disposed, ground-supported tower having upper and lower ends;

a vertically disposed mast secured to said tower and having upper and lower ends;

an antenna support secured to said mast;

said antenna support comprising first, second and third triangular-shaped platform sections joined together to form said antenna support;

each of said platform sections having an inner end and a mounting ring associated therewith which embraces said mast;

said mounting rings being vertically offset with respect to one another to enable said mounting rings to be positioned on said mast in a stacked relationship.

12. In combination:

vertically disposed mast having up per and lower ends;

an antenna platform secured to said mast;

said antenna platform comprising a plurality of platform sections joined together to form said antenna platform;

each of said platform sections having an inner end and a mounting ring associated therewith which embraces said mast;

said antenna platform comprising first, second and third platform sections;

each of said platform sections being triangular-shaped;

said mounting rings being vertically offset with respect to one another to enable said mounting rings to be positioned on said mast in a stacked relationship.

* * * * *